US010639220B1

(12) United States Patent
Smith

(10) Patent No.: US 10,639,220 B1
(45) Date of Patent: May 5, 2020

(54) COLLAPSIBLE PERSONAL LIFT

(71) Applicant: Donna Marie Antoinette Smith, West Islip, NY (US)

(72) Inventor: Donna Marie Antoinette Smith, West Islip, NY (US)

( * ) Notice: Subject to any disclaimer, the term of this patent is extended or adjusted under 35 U.S.C. 154(b) by 0 days.

(21) Appl. No.: 16/354,532

(22) Filed: Mar. 15, 2019

(51) Int. Cl.
*A61G 5/14* (2006.01)
*A61G 5/10* (2006.01)
*A61G 7/10* (2006.01)

(52) U.S. Cl.
CPC ..... *A61G 5/14* (2013.01); *A61G 5/1059* (2013.01); *A61G 7/1019* (2013.01); *A61G 7/1021* (2013.01); *A61G 7/1059* (2013.01); *A61G 7/1086* (2013.01); *A61G 2200/34* (2013.01); *A61G 2200/36* (2013.01)

(58) Field of Classification Search
CPC ..... A61G 5/14; A61G 5/1059; A61G 7/1019; A61G 7/1021; A61G 7/1059; A61G 7/1086; A61G 2200/354; A61G 2200/36
See application file for complete search history.

(56) References Cited

U.S. PATENT DOCUMENTS 2,725,578 A * 12/1955 Keller ..... A61G 7/1059 4/565.1
4,249,749 A * 2/1981 Collier ..... B62B 1/00 108/145
4,660,234 A * 4/1987 Schmidt ..... A61G 7/1003 4/566.1
4,688,760 A * 8/1987 Garman ..... A47C 3/30 254/122
5,800,016 A 9/1998 Allred
5,918,936 A * 7/1999 Murphy ..... A61G 5/14 297/313
6,135,412 A 10/2000 Buehler
6,430,761 B1 * 8/2002 Brandorff ..... A61G 7/053 5/81.1 R
6,540,250 B1 4/2003 Peterson
6,619,735 B1 9/2003 Ming-Hwa
6,834,404 B2 * 12/2004 Fletcher ..... A61G 7/1003 5/611
6,935,648 B2 * 8/2005 Beck ..... A61G 5/1059 280/250.1

(Continued)

FOREIGN PATENT DOCUMENTS

GB 2014446 A * 8/1979 ..... A61G 7/1019

*Primary Examiner* — James A Shriver, II
*Assistant Examiner* — Steve Clemmons
(74) *Attorney, Agent, or Firm* — Allen F. Bennett; Bennett Intellectual Property

(57) ABSTRACT

A collapsible, portable personal lift assists a user in translating from a fully upright position to a position sitting on a floor. The personal lift is easily collapsed into a compact storage configuration and includes wheels and a handle for easy transport of the lift to any location. The personal lift utilizes an air pump to fill two separate airbags. An elevating airbag raises the chair of the personal lift from the floor to a raised position. A second tilting airbag is used to tilt the chair forward to assist the user in standing up. The airbags may be deflated to assist the user and going from an upright standing position to a seated position on the floor. The personal lift utilizes scissor joints positions around the elevating airbag to stabilize the device as the airbags are inflated and deflated.

1 Claim, 5 Drawing Sheets

(56) References Cited

U.S. PATENT DOCUMENTS

| | | | | |
|---|---|---|---|---|
| 7,090,241 | B2 * | 8/2006 | Silva | A61G 5/1059 280/250.1 |
| 8,267,474 | B2 * | 9/2012 | Fetisoff | A61G 5/1059 297/338 |
| 9,254,233 | B2 * | 2/2016 | Schy | A61G 7/1011 |
| 9,414,987 | B2 * | 8/2016 | Bagheri | A61H 3/008 |
| 9,629,765 | B1 * | 4/2017 | Mitchell | A61G 5/14 |
| 9,675,508 | B2 * | 6/2017 | Hall | B66F 3/247 |
| 10,080,701 | B1 * | 9/2018 | Bagheri | A61H 3/04 |
| 2004/0026977 | A1 * | 2/2004 | Vaughan | A61G 5/14 297/344.16 |
| 2007/0086880 | A1 | 4/2007 | Jordan | |
| 2010/0219668 | A1 | 9/2010 | Nelson | |
| 2014/0042783 | A1 | 2/2014 | St. Pierre et al. | |
| 2014/0265232 | A1 | 9/2014 | Lin | |
| 2015/0137567 | A1 * | 5/2015 | Smith | A61G 5/1059 297/183.1 |

* cited by examiner

COLLAPSIBLE PERSONAL LIFT

STATEMENT REGARDING FEDERALLY SPONSORED RESEARCH OR DEVELOPMENT

Not Applicable.

NAMES OF PARTIES TO A JOINT RESEARCH AGREEMENT

Not Applicable

REFERENCE TO SEQUENCE LISTING, A TABLE, OR A COMPUTER PROGRAM LISTING APPENDIX SUBMITTED ON A COMPACT DISC AND INCORPORATION-BY-REFERENCE OF THE MATERIAL

Not Applicable.

COPYRIGHT NOTICE

Not Applicable

BACKGROUND OF THE INVENTION

Field of the Invention

The present invention relates to a collapsible portable lift. More particularly, the invention relates to a collapsible lift for assisting a user in translating between a standing position and a position seated on a floor using pneumatic pressure and stabilized using one or more scissor joints.

Description of the Related Art

Many individuals suffer from limited mobility by reason of disease, advanced age or disability. A common problem exists for such persons when they need or wish to move from the floor to an upright position, or vice-versa. An individual may have fallen or may have voluntarily moved to a sitting position on the floor and have a difficult time getting back to an upright position so they may stand up. A fall is an obvious situation, but other situations exist that can be embarrassing for a person who is disabled, for instance, where a person has voluntarily placed him or herself down on the floor to play with grandchildren, but cannot get back up without assistance.

Another common situation is when a person is attempting to enter a pool or to sit on the floor to engage in exercises such as for example yoga. Also, there are situations where it is desirable to move in a controlled manner, gradually from a standing position down to the floor. A device is also needed that will assist attendants and helpers to move a disabled person who is located on the floor and wants to stand up, or vice-versa. Most devices that currently exist are bulky and unwieldy, generally being designed for a hospital or other specific environment.

The above-described deficiencies of today's systems are merely intended to provide an overview of some of the problems of conventional systems, and are not intended to be exhaustive. Other problems with the state of the art and corresponding benefits of some of the various non-limiting embodiments may become further apparent upon review of the following detailed description.

In view of the foregoing, it is desirable to provide a collapsible, portable personal lift that is easily stored and transported.

BRIEF SUMMARY OF THE INVENTION

Disclosed is a collapsible, portable lift for assisting users in translating between a fully upright standing position and a position seated on a floor. The device may be folded into a compact configuration suitable for storage and includes a handle and wheels allowing it to be easily transported to almost any location. The device utilizes an elevating airbag to raise the chair of the lift from the floor to an elevated or raised position. A tilting airbag tilts the chair forward to assist a user and translating from a seated to a standing position.

In one embodiment, a collapsible personal lift comprises a base frame, an intermediate frame above the base frame, an elevating airbag extending between the base frame and the intermediate frame, at least two stabilizing scissor joints extending between the base frame and the intermediate frame and peripheral to the elevating airbag. The chair is positioned above the intermediate frame. A hinge connects the front of the intermediate frame with the front of the chair. A tilting airbag extends from the top of the intermediate frame to the bottom of the chair. A backrest is attached to the rear side of the chair by one or more hinges, allowing the backrest to translate between a closed position substantially flush against the chair and an open position extending upward from the rear side of the chair. At least one pair of wheels extending backward from a rear side of the base frame. A handle is attached to the backrest so that the lift may be transported. By inflating the elevating airbag, the lift translates from a lowered position flush with the floor to a raised position parallel to the floor. By inflating the tilting airbag, the chair translates from a level position to a tilted position.

It is therefore an object of the present invention to provide a collapsible, portable chairlift to assist users in translating from a seated position on a floor to an upright, standing position, and vice versa.

These and other objects and advantages of the present invention will become apparent from a reading of the attached specification and appended claims. There has thus been outlined, rather broadly, the more important features of the invention in order that the detailed description thereof that follows may be better understood, and in order that the present contribution to the art may be better appreciated. There are features of the invention that will be described hereinafter and which will form the subject matter of the claims appended hereto.

BRIEF DESCRIPTION OF THE DRAWINGS

A more complete understanding of the present invention, and the attendant advantages and features thereof, will be more readily understood by reference to the following detailed description when considered in conjunction with the accompanying drawings wherein.

DETAILED DESCRIPTION

Figure 1:
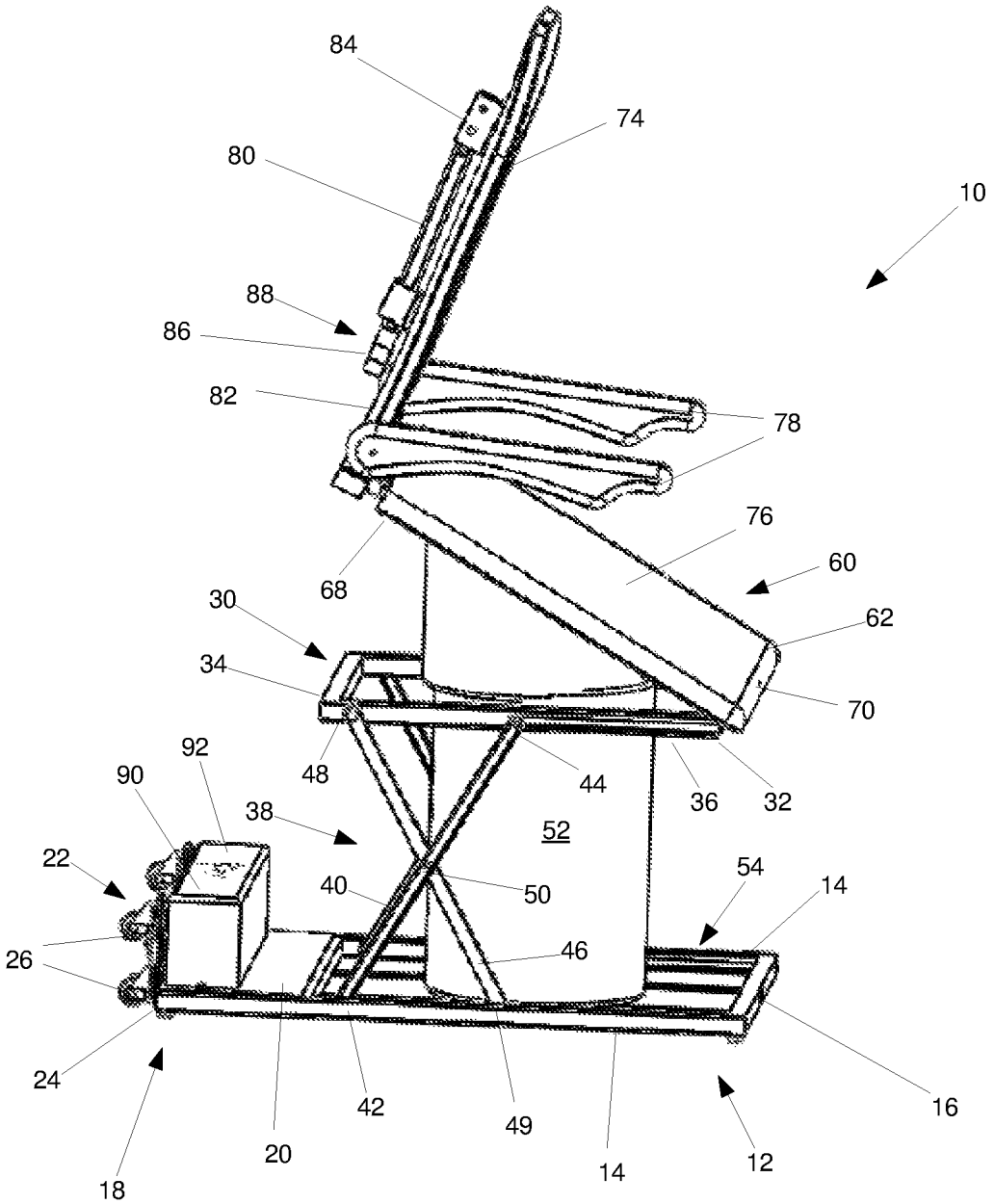
FIG. 1 is a perspective view of a collapsible personal lift in accordance with the principles of the invention.

The invention is not limited in its application to the details of construction and to the arrangements of the components set forth in the following description or illustrated in the drawings. The invention is capable of other embodiments and of being practiced and carried out in various ways. Also, it is to be understood that the phraseology and terminology employed herein are for the purpose of description and should not be regarded as limiting.

The disclosed subject matter is described with reference to the drawings, wherein like reference numerals are used to refer to like elements throughout. In the following description, for purposes of explanation, numerous specific details are set forth in order to provide a thorough understanding of the various embodiments of the subject disclosure. It may be evident, however, that the disclosed subject matter may be practiced without these specific details. In other instances, well-known structures and devices are shown in block diagram form in order to facilitate describing the various embodiments herein.

In addition, the term "or" is intended to mean an inclusive "or" rather than an exclusive "or." That is, unless specified otherwise, or clear from context, "X employs A or B" is intended to mean any of the natural inclusive permutations. That is, if X employs A; X employs B; or X employs both A and B, then "X employs A or B" is satisfied under any of the foregoing instances. Moreover, articles "a" and "an" as used in the subject specification and annexed drawings should generally be construed to mean "one or more" unless specified otherwise or clear from context to be directed to a singular form.

Disclosed is a collapsible, portable lift for assisting users in translating between a fully upright standing position and a position seated on a floor. The device may be folded into a compact configuration suitable for storage and includes a handle and wheels allowing it to be easily transported to almost any location. The device utilizes an elevating airbag to raise the chair of the lift from the floor to an elevated or raised position. A tilting airbag tilts the chair forward to assist a user and translating from a seated to a standing position.

Figure 2:
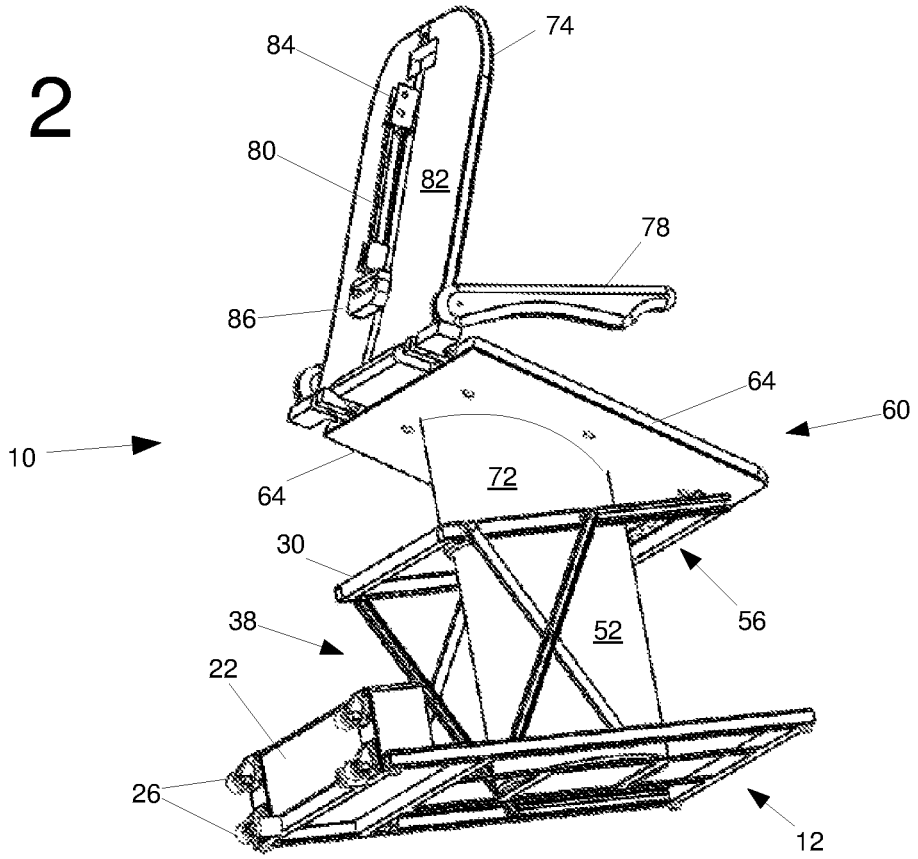
FIG. 2 is another perspective view of a collapsible portable lift in accordance with the principles of the invention.

FIGS. 1 and 2 show a collapsible personal lift 10 in accordance with principles of the invention. The lift 10 has a base frame 12 that is substantially flat and rigid. In this embodiment, the base frame 10 is comprised of several metal struts but may optionally be formed from a continuous sheet of metal. In this embodiment, the base frame 12 has two opposing parallel lateral sides 14, a front 16 and a rear 18. The base frame 12 includes a shelf 20 at the rear 18 and a vertical truck 22 extending upward from the back edge 24. The vertical truck 22 includes a plurality of casters 26.

An intermediate frame 30 is positioned directly above and parallel to the base frame 12. The intermediate frame also has a front 32, a rear 34 and two opposing parallel lateral sides 36. An inflatable and collapsible elevating airbag 52 extends from the top 54 of the base frame 12 to the bottom 56 of the intermediate frame 30. The elevating airbag 52 is substantially cylindrical and when fully inflated its top and bottom ends are parallel. The elevating airbag 52 may optionally take other configurations such as a hexagon or a square so long as the top and bottom ends of the airbag are parallel when fully inflated.

In this embodiment, each of the intermediate lateral sides 36 are connected to the lateral sides 14 of the base frame 12 by a scissor joint 38. Unlike a scissor lift, the scissor joints 38 are not actuated but are incorporated into the design in order to stabilize the personal lift 10 as it is raised and lowered. Each scissor joint 38 includes a first strut 40 pivotally engaged to a lateral side 14 of the base frame 12 by a pivot joint 42 and slidingly engaged with a lateral side 36 of the intermediate frame 30 at its sliding end 44. Each scissor joint 38 also includes a second strut 46 pivotally engaged to a lateral side 36 of the intermediate frame 30 by a pivot joint 48 and slidingly engaged at its sliding end 49 with the lateral side 14 of the base frame 12. The first strut 40 and the second strut 36 are also joined by a pivot pin 50. Those skilled in the art will appreciate that each strut of a scissor joint will have one pivoting end and one sliding end. The sliding end typically is engaged within a channel that allows sliding a specific distance, thereby allowing the scissor joint to flatten to raise to a maximum height. The scissor joints 38 are positioned on either side of the elevating airbag 52. It may be desirable to include additional scissor joints around the airbag in order to improve stability of the lift 10 as it is raised and lowered.

A chair 60 is positioned above the intermediate frame 30 and includes a front 62 and two opposing lateral sides 64 as well as a rear 68. The front 62 is connected to the front 32 of the intermediate frame 30 by a hinge 70 that allows the chair to tilt forward when the tilting airbag 72 is inflated. A backrest 74 is attached to the rear 68 of the chair 60 and may be folded down to lie flush against the top 76 of the chair 60. In this embodiment, the chair 60 also includes two armrests 78. An arm 80 is attached to the back side 82 of the backrest 74 by a pivot joint 84 and has a handle 86 at its distal end 88.

An air pump 90 and battery 92 may be attached to the shelf 20 at the rear of the base 12. The personal lift may be raised and lowered by inflating and deflating the elevating airbag 52. The chair 60 may be tilted forward by inflating the tilting airbag 72.

Figure 3:
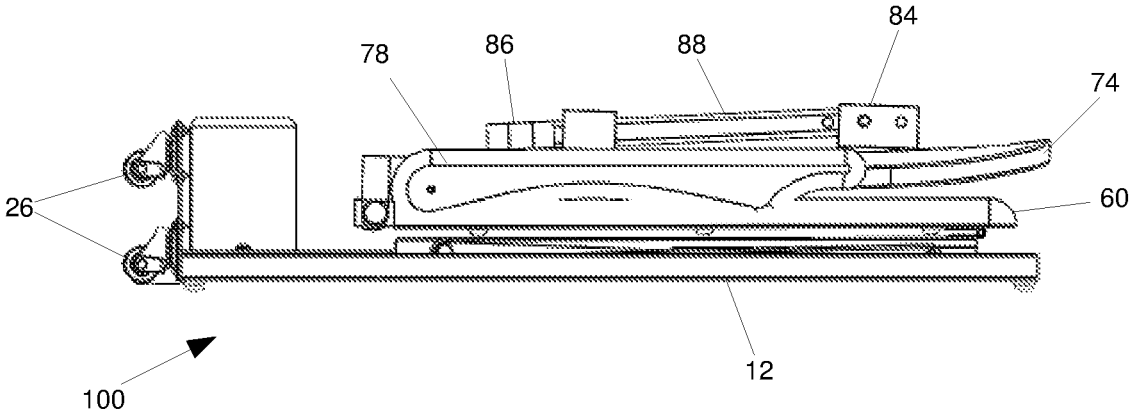
FIG. 3 is a perspective view of a collapsible portable lift in the storage configuration in accordance with the principles of the invention.
Figure 4:
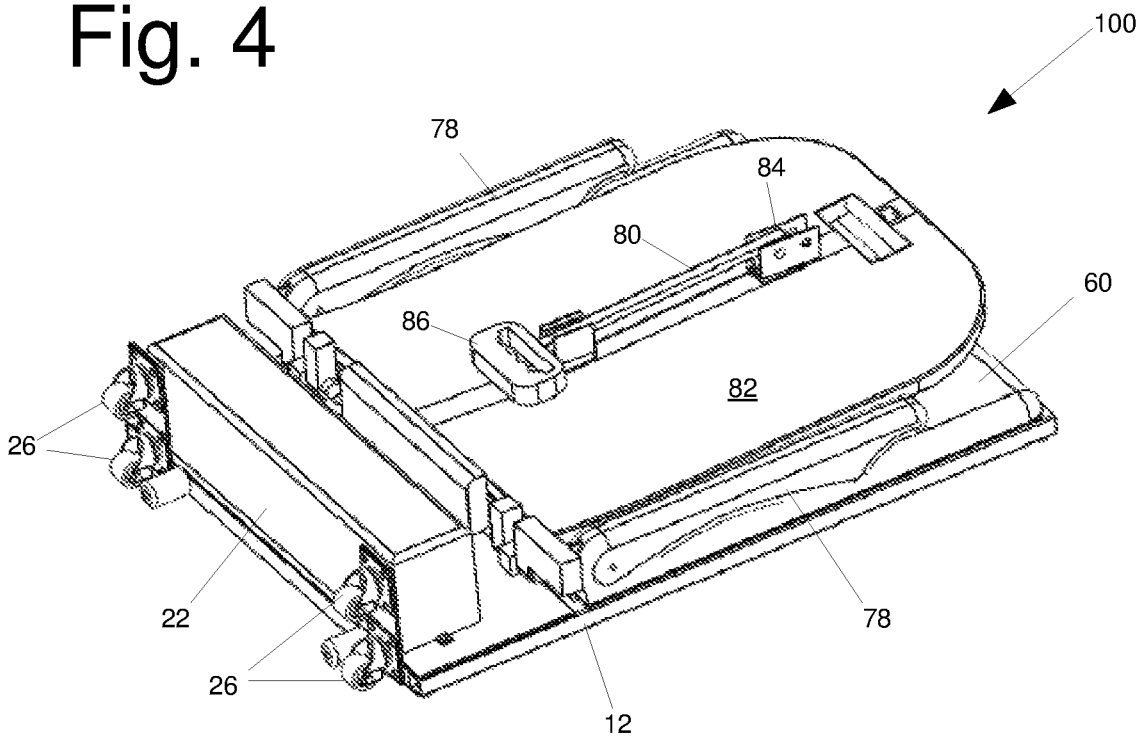
FIG. 4 is another perspective view of a collapsible portable lift in the storage configuration in accordance with principles of the invention.
Figure 5:
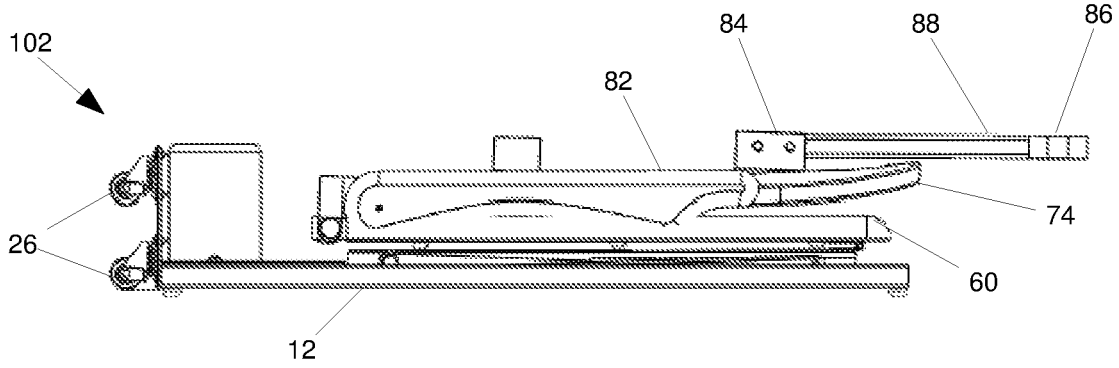
FIG. 5 is a perspective view of a collapsible portable lift in the portable configuration in accordance with the principles of the invention.
Figure 6:
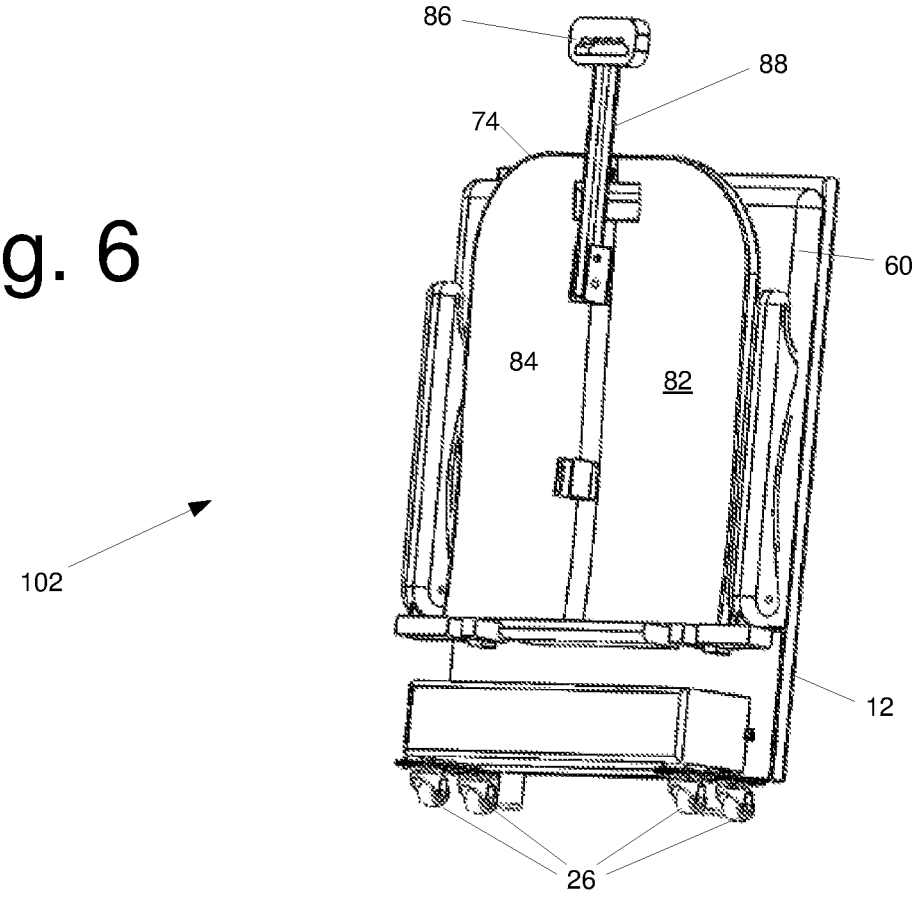
FIG. 6 is another perspective view of a collapsible portable lift in the portable configuration in accordance with the principles of the invention.

FIGS. 3 and 4 show the personal lift 10 in a compact storage configuration 100. Both airbags 52 and 72 are deflated and the backrest 74 is folded against the chair 60. The storage configuration 100 is suitable for storing the device in the trunk of a car, a closet, under a bed or other convenient storage location. FIGS. 5 and 6 show the personal lift 10 in a transporting configuration 102. In the transporting configuration 102, the arm 80 has been pivoted about the pivot joint 84 such that the handle 86 extends outward from the front of the lift 10. A user may grasp the lift 10 by the handle 86 such that the casters 26 engage the ground and the lift 10 may be dragged in the same manner as a piece of luggage.

Figure 7:
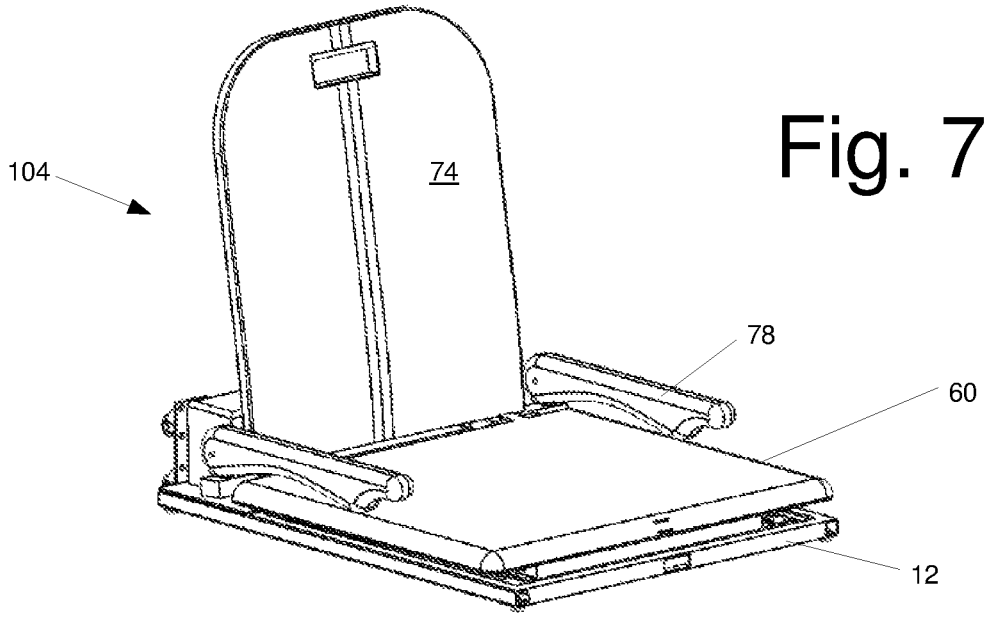
FIG. 7 is a perspective view of a collapsible portable lift in the lowered configuration in accordance with principles of the invention.

FIG. 7 shows the lift 10 in the lowered configuration 104. A person having limited mobility using the personal lift 10 to raise off the floor will begin by placing the lift 10 in the lowered configuration 104. The backrest 74 has been rotated upward, but both the tilting airbag 72 and the lifting airbag 52 are entirely deflated. The chair 60 lies flush against the intermediate frame 30 which in turn lies flush against the base frame 12 which is flush against a floor. A user positions him or herself on the chair 60 with his or her back against the backrest 74. Once comfortably and securely positioned on the chair 60, the user engages the air pump 90 to inflate the elevating airbag 52. The elevating airbag 52 slowly inflates, thereby raising the intermediate frame 30 upward from the base frame 12. The scissor joints 38 stabilize the intermediate frame 30 and base frame 12 to reduce wavering of the chair 60 as the airbag 52 is inflated.

Figure 8:
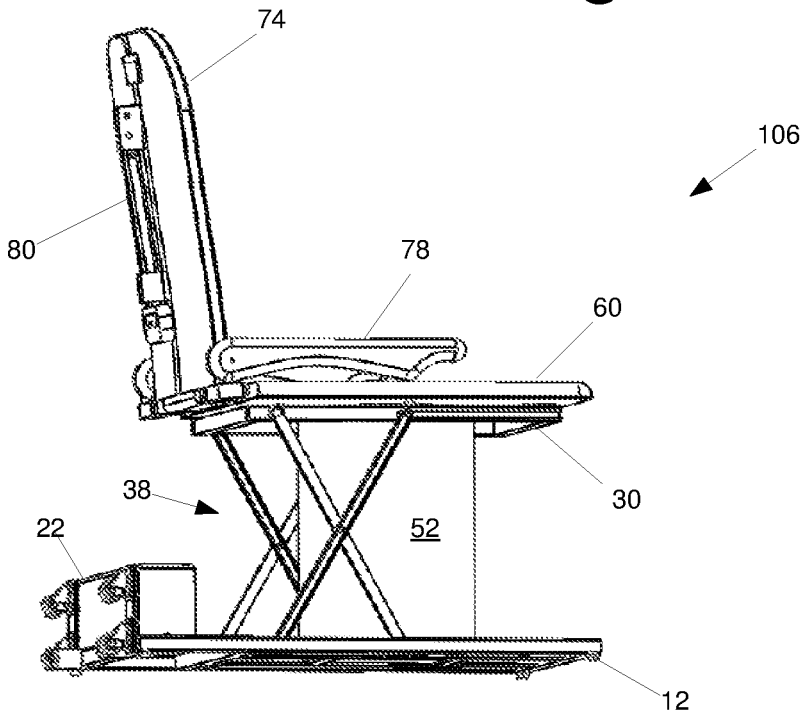
FIG. 8 is a perspective view of a collapsible portable lift in the elevated configuration in accordance with the principles of the invention.
Figure 9:
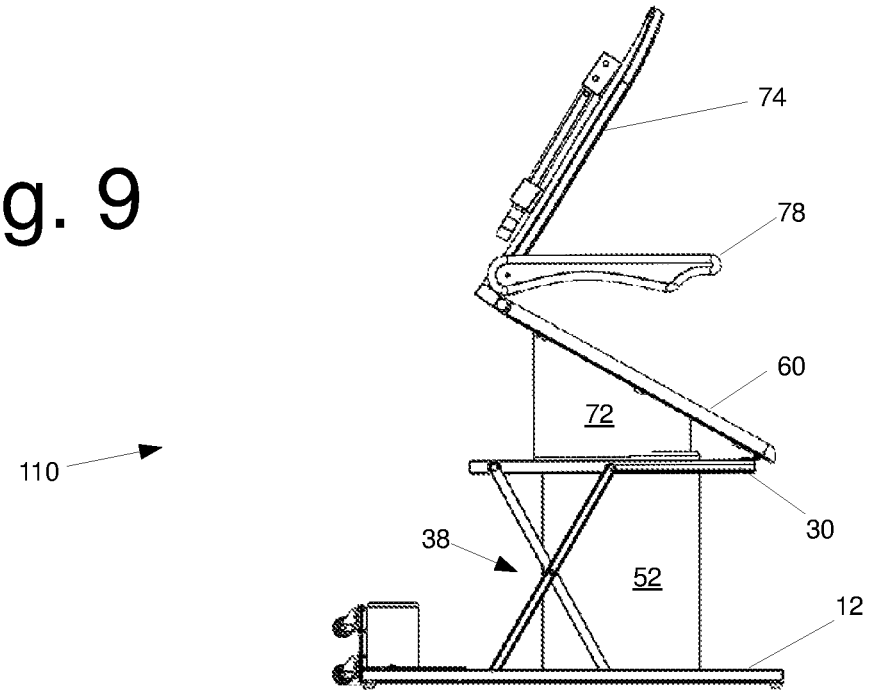
FIG. 9 is a perspective view of a collapsible portable lift in the fully raised and tilted configuration in accordance with principles of the invention.

FIG. 8 shows the lift 10 in the elevated configuration 106. In this configuration, the lift 10 acts as a chair. Some users may be satisfied at this stage and not require further assistance to reach a standing position. Other users may prefer to utilize the tilting airbag to fully raise the personal lift 10. The user may utilize the air pump to inflate the tilting airbag 72 and so the lift 10 is in the fully raised configuration 110 shown in FIG. 9. The tilting airbag 72 extends between the intermediate frame 30 and the chair 60. As it is inflated, the chair 60 pivots around the hinge 70 such that it tilts forward. When the lift 10 is fully raised, the chair is tilted approximately 45°. The armrests 78 may be configured to remain parallel to the intermediate frame 34 to the chair 60. By tilting the chair 60, the lift 10 assists a user in achieving a standing position. A user may utilize the lift 10 to go from a standing position to a position on the floor by utilizing the personal lift 10 in a manner opposite to that explained above.

Whereas, the present invention has been described in relation to the drawings attached hereto, other and further modifications, apart from those shown or suggested herein, may be made within the spirit and scope of this invention. Those skilled in the art will appreciate that the conception, upon which this disclosure is based, may readily be utilized as a basis for the designing of other structures, methods and systems for carrying out the several purposes of the present invention. Descriptions of the embodiments shown in the drawings should not be construed as limiting or defining the ordinary and plain meanings of the terms of the claims unless such is explicitly indicated. The claims should be regarded as including such equivalent constructions insofar as they do not depart from the spirit and scope of the present invention.

The invention claimed is:

1. A collapsible personal lift comprising:

a base frame;

an intermediate frame above the base frame;

an elevating airbag extending between the base frame and the intermediate frame;

at least two stabilizing scissor joints extending between the base frame and the intermediate frame and peripheral to the elevating airbag;

a chair above the intermediate frame;

a hinge connecting a front of the intermediate frame with a front of the chair;

a tilting airbag extending from the top of the intermediate frame to the bottom of the chair;

a backrest attached to a rear side of the chair by one or more hinges allowing the backrest to translate between a closed position substantially flush against the chair and an open position extending upward from the rear side of the chair;

a vertical truck extending upward from a back edge of the base frame;

at least two pairs of wheels extending backward from the vertical truck; and, a handle attached to a back of the backrest by a pivot joint;

wherein inflating the elevating airbag causes the intermediate frame to translate from a lowered position flush with the base frame to a raised position parallel to the base frame; and, wherein inflating the tilting airbag causes the chair to translate from a level position flush against the intermediate frame to a tilted position;

wherein the collapsible personal lift translates into a compact storage configuration when the elevating airbag is deflated such that the intermediate frame is flush with the base frame, the tilting airbag is deflated such that the chair is flush against the intermediate frame, the backrest is folded flush against the chair, and the handle is pivoted about the pivot joint such that it extends outward from the front of the collapsible personal lift.

* * * * *